United States Patent [19]

Ellmore

[11] 4,231,191

[45] Nov. 4, 1980

[54] AUTOMATIC DOOR OPENER SYSTEM

[75] Inventor: John W. Ellmore, West Chester, Pa.

[73] Assignee: Challenger, Inc., Greenbrook, N.J.

[21] Appl. No.: 914,420

[22] Filed: Jun. 12, 1978

[51] Int. Cl.[3] ..... E05F 15/10

[52] U.S. Cl. ..... 49/28; 49/139; 49/199; 49/360

[58] Field of Search ..... 49/28, 26, 199, 139, 49/140, 360; 160/188, 331; 16/94 R; 248/251

[56] References Cited

U.S. PATENT DOCUMENTS

| | | | |
|---|---|---|---|
| 2,084,733 | 6/1937 | Kahliff | 49/199 X |
| 2,544,239 | 3/1951 | Schirmer | 49/139 X |
| 2,851,266 | 9/1958 | Klamp | 49/26 X |
| 2,887,311 | 5/1959 | Klamp | 49/28 X |
| 2,992,819 | 7/1961 | Jackson | 49/28 |
| 3,297,078 | 1/1967 | Miki | 160/331 |
| 3,625,328 | 12/1971 | Carli | 49/28 |
| 3,909,980 | 10/1975 | Courtney et al. | 49/199 |
| 3,949,960 | 4/1976 | McKee | 248/251 |
| 3,955,661 | 5/1976 | Popper et al. | 49/28 X |
| 4,107,877 | 8/1978 | Lee | 49/28 |

*Primary Examiner*—Philip C. Kannan

*Attorney, Agent, or Firm*—John J. Lipari

[57] ABSTRACT

A door opener system which includes a compact unit containing a motor, circuitry and various accessories, which can be quickly connected to and disconnected from the operator system, said motor having a first gear which easily is positioned into a meshing relationship with a second gear upon connection of the compact unit to the operator system. The operator system further includes the use of only two common switch actuators for operating the motor to move the door in open and closed positions, and to stop the motor upon the door striking an obstruction in its path of travel, said actuators being cooperatively associated with a cam actuator and drive chain pressure responsive means. Also, a unitary gear and drive sprocket structure is utilized in the drive system. Finally, an adjustable shock absorber type draw bar interconnects the door to the chain drive.

12 Claims, 13 Drawing Figures

AUTOMATIC DOOR OPENER SYSTEM

This invention relates to an automatic door opening and closing system which employs a reversible electric motor for automatically opening and closing a garage door. More specifically, this invention relates to an automatic door opener system which includes a compact unit containing a motor and related accessories which can be quickly connected to and disconnected from an operator system having fewer, lighter, smaller and more simplified and more durable components than those found in the prior art.

Heretofore, conventional door opener systems consisted of large motor units containing numerous circuits and related components therein. Further, the assembly of such door opener systems was most difficult and often required a skilled installer to install same. The systems were installed in such a manner that, in the event there was a malfunction, access to and repair of the operator often was required by a skilled repair man at the garage. As a result, there was much down time until the skilled repair man could come to the garage to repair the system.

Due to the aforesaid numerous components and large size of the operator systems, the cost of maintaining a large warehouse inventory and/or shipping same was relatively costly. Also, due to the large size and complexity of the systems, the marketability of selling a garage door with substantially most of the operator system connected thereto was remote. Further, serviceability of the operator system was relatively often and costly, due to the complexity of said systems coupled with the fact that a skilled technician was required.

SUMMARY AND OBJECTS OF THE INVENTION

It is an object of this invention to obviate the above described difficulties of the prior art and to provide a compact, light weighted and more efficient operator system It is a further object of this invention to provide a door operator system which includes a compact unit containing a motor with related circuitry and accessories therein, said unit capable of being quickly connected to and disconnected from the operator system.

It is a further object of this invention to provide an integrated driven gear, shaft and chain sprocket structure for use in the operator system.

It is a further object of this invention to provide a pair of common switches for controlling the electric motor drive, said switches being cooperatively associated with a chain lever pressure responsive means and an actuating cam.

It is still a further object of this invention to provide an adjustable shock absorbent draw bar unit which interconnects the chain drive to the door.

Finally, it is an object of this invention to provide a chain trolley which can be quickly disconnected from the chain drive due to a power failure, thereby permitting the door to be opened and closed manually.

The above objects and others are accomplished by providing, in general, a compact unit containing a motor and related circuitry therein, said motor having a helical shaft extending therefrom for engagement with a helical gear upon connection of the compact unit to a pair of guide rails. The helical gear is part of a unitary structure having a sprocket thereon for operating a chain drive system which is provided with a draw bar unit connected to a door for opening and closing same. The compact unit is provided with locking means which are cooperatively associated with a guide rail unit for simple connection and disconnection thereto, said rail unit capable of being connected to any desired overhead joist by adjustable bracket means thereon.

Operation of a reversible electric motor is provided by the use of a pair of switch means, each having an actuator. An actuating cam and chain load responsive lever each are capable of occupying and functioning to depress and release respective one-half surface areas of each actuator, said cam actuator and load responsive lever being cooperatively associated with each other and movable between alternating first and second positions for not only normally starting and stopping the chain drive system but also for starting and stopping the chain drive system due to the door striking an obstruction in its path of travel.

An adjustable draw bar unit is provided for interconnecting the chain drive with the door, said unit including an arcuately shaped tubular member having a coiled spring located therein, said spring being compressed near one end of the member which is connected to the door. A pin having a hook portion at one end thereof for connection to the chain drive is provided with a plurality of pre-arranged projecting nibs along its shank, said pin being positioned within the spring at a depth sufficient to cause the draw bar to be interconnected with the door and chain drive under the desired tension, said projecting nibs holding the pin in a secured position with the spring.

Other objects and advantages of the invention shall be apparent from the following detailed description of the preferred embodiment made with reference to the accompanying drawings forming a part of the specification and in which.

DESCRIPTION OF THE PREFERRED EMBODIMENT

Figure 1:
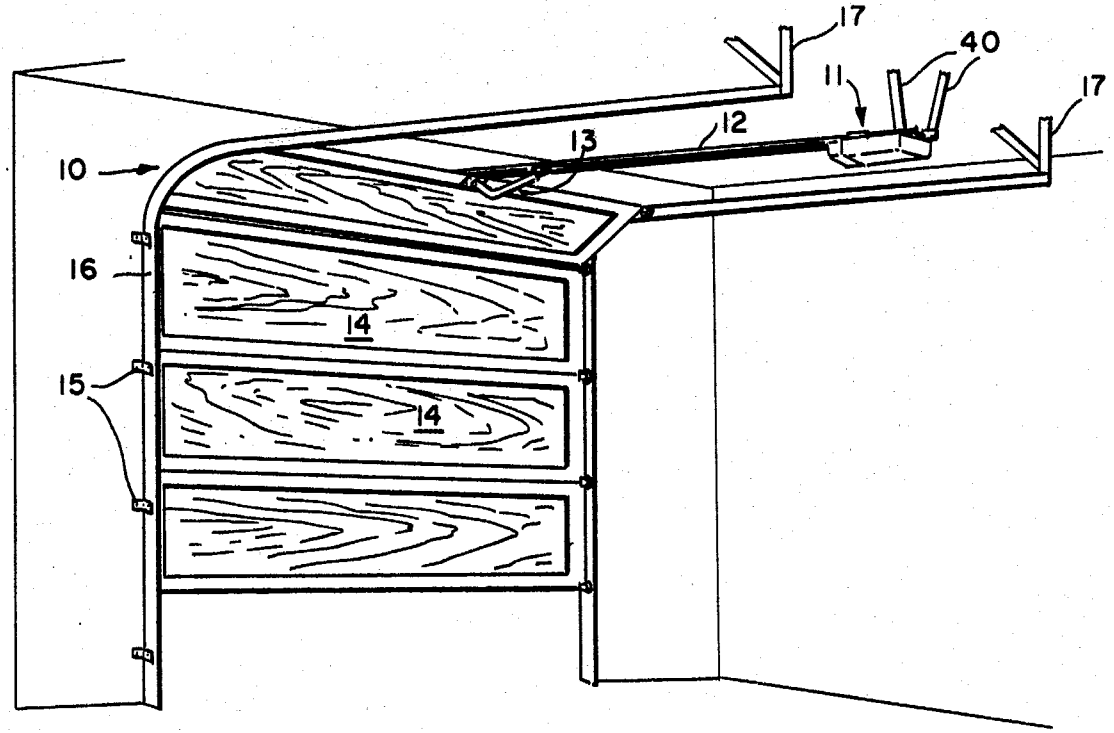
FIG. 1 is a perspective view generally disclosing a garage door with the compact motor unit, chain-drive and draw bar unit of the present invention.

With reference to the drawings, FIG. 1 depicts a typical overhead door 10 cooperatively associated with a door opener system which generally refers to a compact operator unit 11, and a continuous chain drive 12 connected to a door connecting or draw bar 13 which is connected to door 10. The door is conventionally formed of a plurality of hinged sections 14—14 having rollers 15 located near the ends thereof for travel along a pair of channelled L-shaped rail tracks 16, which are mounted along the adjacent door wall and to brackets 17—17 extending from the ceiling so that the rail tracks are in substantially parallel spaced relationship with the floor of the garage. Accordingly, when the door is in the fully raised or open position, it rests in substantially parallel relationship with the garage floor.

As seen in FIGS. 2, 3, 4 and 5, compact unit 11 contains a motor 20 and various circuitry and accessories (not shown) for use in the door opening and closing operation. Motor 20 drives a helical gear shaft 21 that meshes with an integral driven unit, made of preferably plastic material, such as Zytel. The integral driven unit includes a helical driven gear 22 having a shaft 23 which extends into a provided opening 24 of a cover 25 located thereover, said integral driven unit also including a chain driven means unit which includes sprocket 26 driving endless chain 12. The helical driven gear 22 is located over a supporting plate 27 which extends from L-shaped guide rails 30—30. Cover 25 is provided with opposing angular flanges **25*a*—25*a* which extend over the outer surfaces of guide rails 30—30 and is secured to said guide rails by sliding the cover along the guide rails until U-shaped slots 31—31, located on the leading ends of the flanges 25*a*—25*a*, are received at a desired location within the slots by respective screws 32—32 extending from the guide rails. At this point, shaft 23 is located within opening 24 and locating pins 33—33 are inserted into provided openings in the cover which are in alignment with respective openings in supporting plate 27. Nuts 34—34 are connected to screws 32—32 and locking pins 33—33** respectively to secure the cover to the guide rails. In this manner, the cover protects the driven unit from dust and foreign matter, and provides a safety measure to anyone who may be in the vicinity thereof.

Compact unit 11 is quickly connected to and removable from the guide rails by inserting a pair of screws 35—35 and flat headed pins 36—36, which extend from the top surface of the compact unit, into substantially round locating slots 37—37 positioned on the bottom surfaces of the guide rails. After the screws 35—35 and flat headed pins 36—36 are located in their respective slots 37—37, the compact unit is moved axially along the rails so that the screws and pins, in turn, are moved into narrow channels **37*a*—37*a* communicating with the round locating slots 37—37. Accordingly, the flat headed pins 36—36 are snugly received within their respective channels 37*a*—37*a*, and nuts 38—38 are threadedly connected to their respective screws 35—35 to securely lock the compact unit 11 to the rails. As a result of the foregoing axial movement of the compact unit, helical gear shaft 21 is positioned into mesh with the helical gear 22. In this manner, whenever there is any malfunctioning or problem with the circuitry, accessories or motor located within compact unit 11**, said unit may be quickly replaced with another unit during the time period that the malfunctioning unit is being repaired, so as to drastically minimize down time and use of the automatic door opener.

Figure 6:
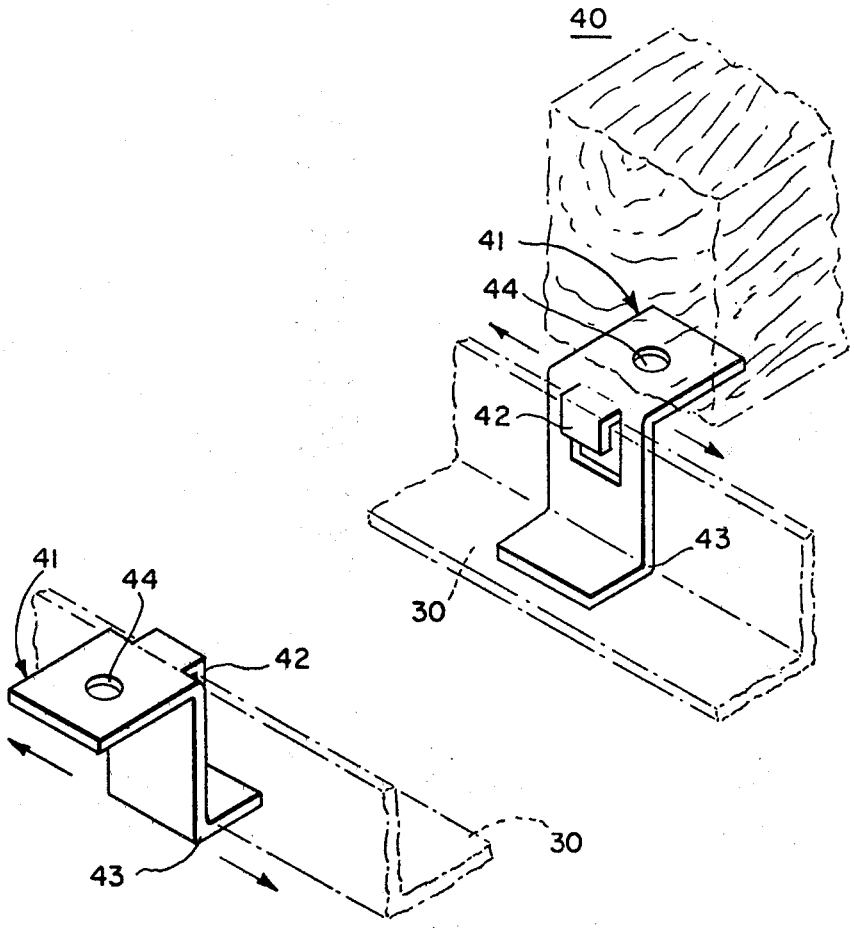
FIG. 6 is an isometric view of adjustably, movable joist mounting brackets located on the guide rails.

One end of the L-shaped guide rails 30—30 is connected to brackets 40—40 (FIG. 1) extending from the ceiling. As seen in FIG. 6, a pair of sliding hanger brackets 41—41 are located on the guide rails 30—30 and are movable therealong until same are located in alignment with the ceiling brackets 40—40 for connection therewith. Each hanger bracket 41 is provided with an L-shaped tab 42 which is punched or stamped out from the bracket body and rides over the top and inner surface of guide rail 30. The bottom portion of the hanger bracket is provided with an L-shaped flange 43 for riding along the outer lateral and bottom surface of guide rail 30. Accordingly, regardless of where a joice (not shown) extends from the garage ceiling to support ceiling brackets 40—40, guide rails 30—30 can be quickly connected thereto by sliding the hanger brackets 41—41 along guide rails 30—30 until hanger bracket opening 44 is in alignment with the ceiling bracket for connection thereto by any conventional fastening means.

Figure 7:
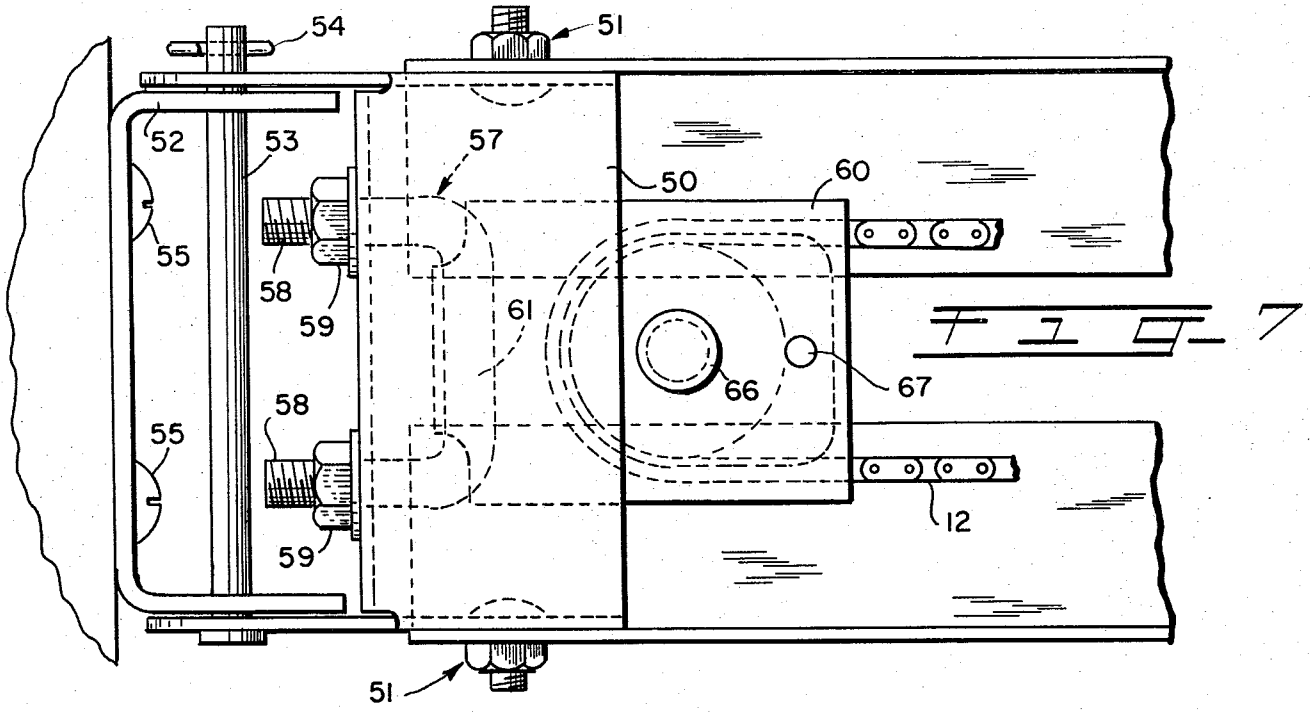
FIG. 7 is a plan view of the other end portion of the driven gear system and chain stabilizer unit.
Figure 8:
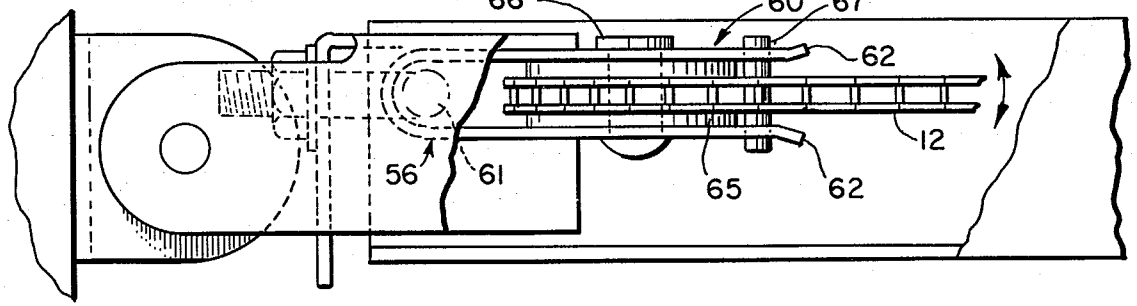
FIG. 8 is a side view, in partial cross-section of the view shown in FIG. 7.

The other end of the L-shaped guide rails 30—30, as seen in FIGS. 7 and 8, are connected to a housing cover 50 by conventional fastening means 51—51. The housing cover 50 is pivotally connected to a U-shaped bracket 52 via a pin 53 extending through said bracket 52 and housing cover 50, the free end of said pin being provided with a cotter pin 54 for holding same in a secured position. The bracket 52 is secured to the garage wall by any conventional fastening means 55—55. Located within and secured to the housing cover 50 is a chain stabilizer, generally referred to at 56, which includes a U-shaped bolt 57 whose free arm ends 58—58 extend through housing 50 and are threadedly connected thereto by respective nuts 59—59. A U-shaped plate 60 is pivotally connected to closed arm 61 of bolt 57, said U-shaped plate having flared end arms 62—62 extending in a direction opposite to the free arm ends 58—58 of U-shaped bolt 57. Located within U-shaped plate 60 is an idler plate 65 about which chain 12 travels. Idler plate 65 which is formed by a pair of spacers providing an area therebetween is provided with a shaft 66 which extends through U-shaped plate 60 and is secured on the outer surfaces thereof. A locking pin 67 extends through U-shaped plate 60 near its flared end arms 62—62. Accordingly, in the event a tension adjustment is required on chain 12, nuts 59—59 can be either loosened or tightened to provide the required tension. Further, in the event there is a slack in chain 12 during the drive thereof, the chain is stabilized due to a pivotal rocking action of U-shaped plate 60 about U-shaped bolt arm 61.

Figure 2:
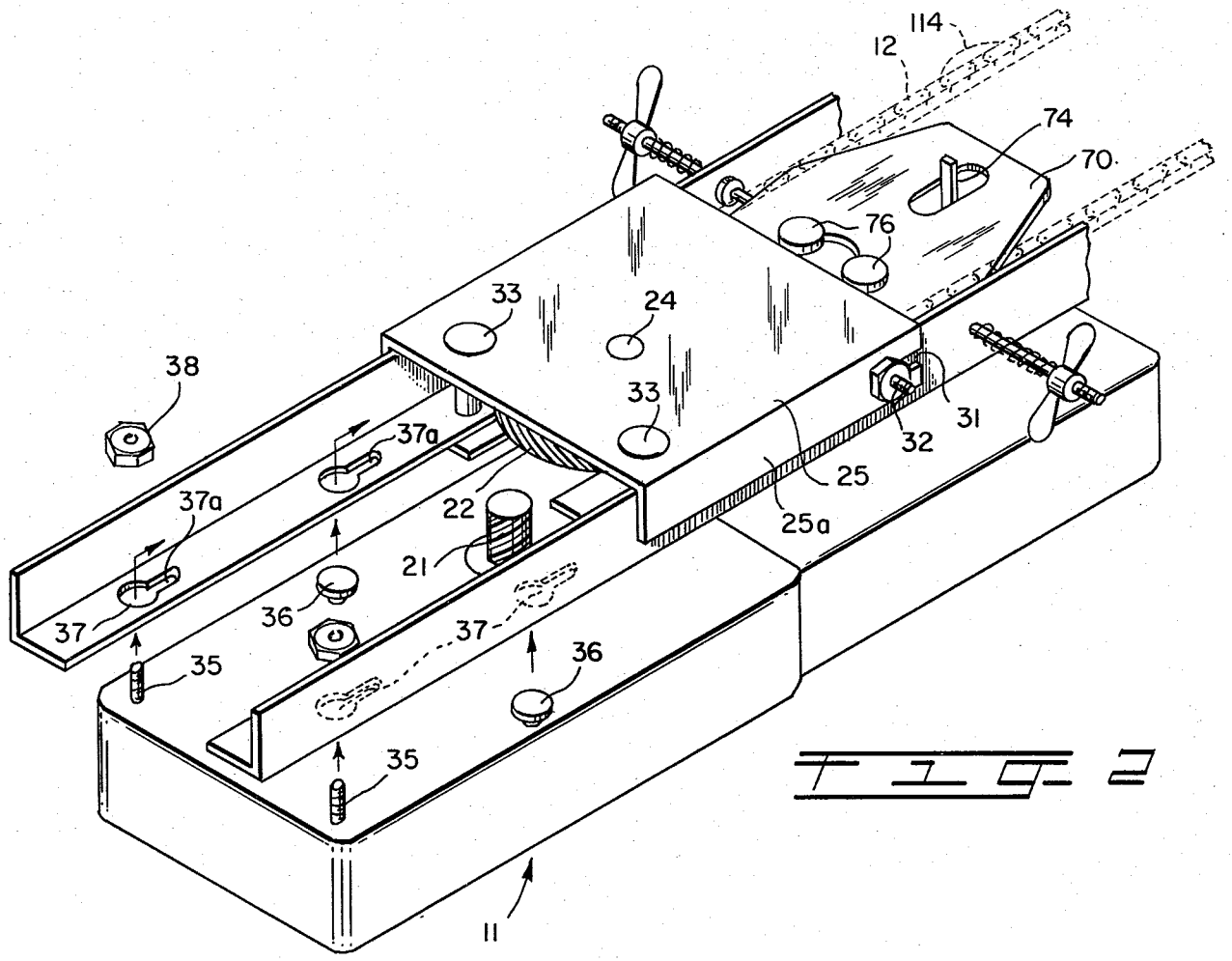
FIG. 2 is a partially exploded, isometric view of the compact motor unit and pressure responsive means.
Figure 3:
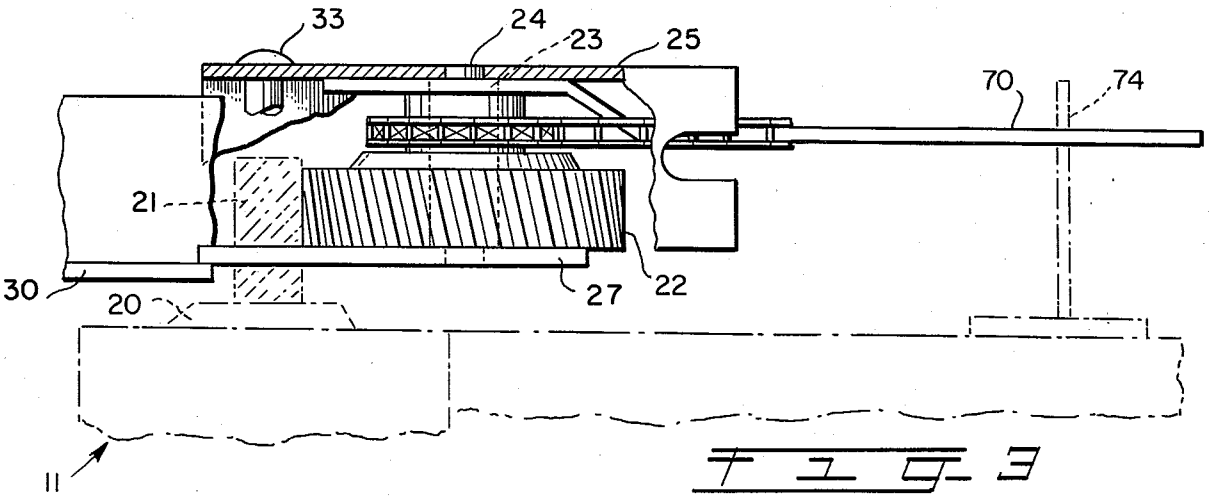
FIG. 3 is a partial cross-sectional view of one end portion of the gear drive means.
Figure 5:
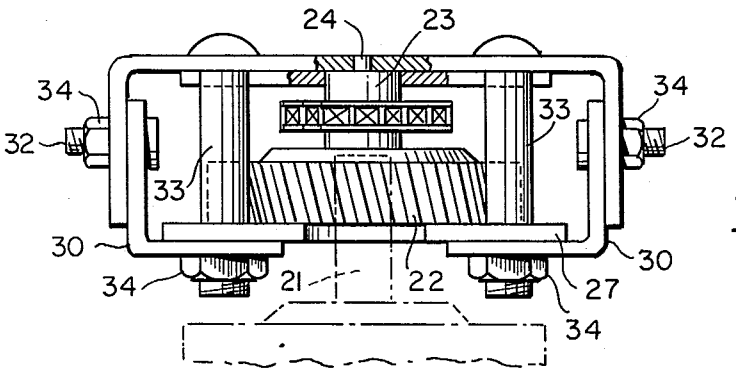
FIG. 5 is a view taken along line 5—5 of FIG. 4.
Figure 4:
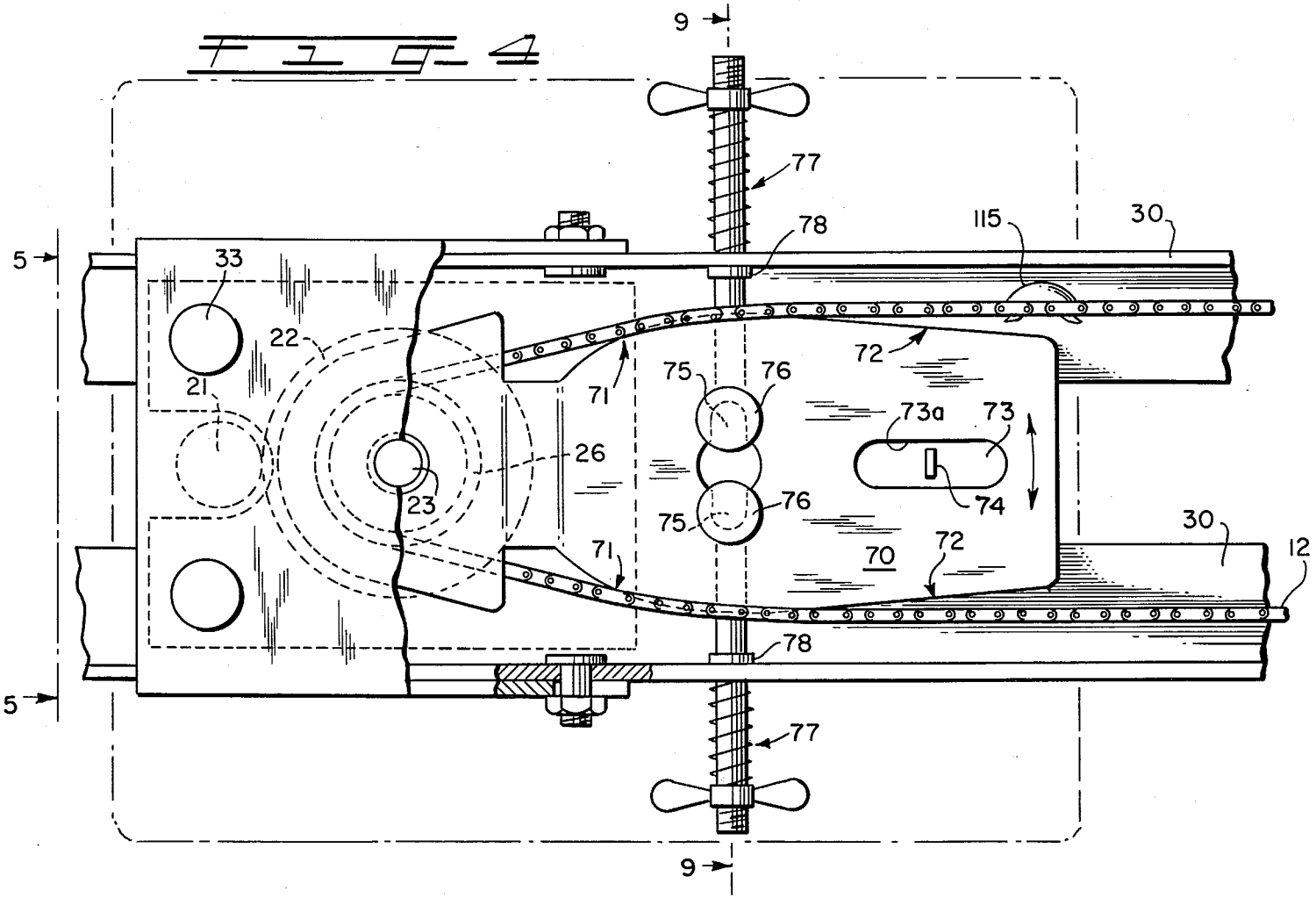
FIG. 4 is a plan view with a cut-away section of the load lever pressure responsive means.
Figure 9:
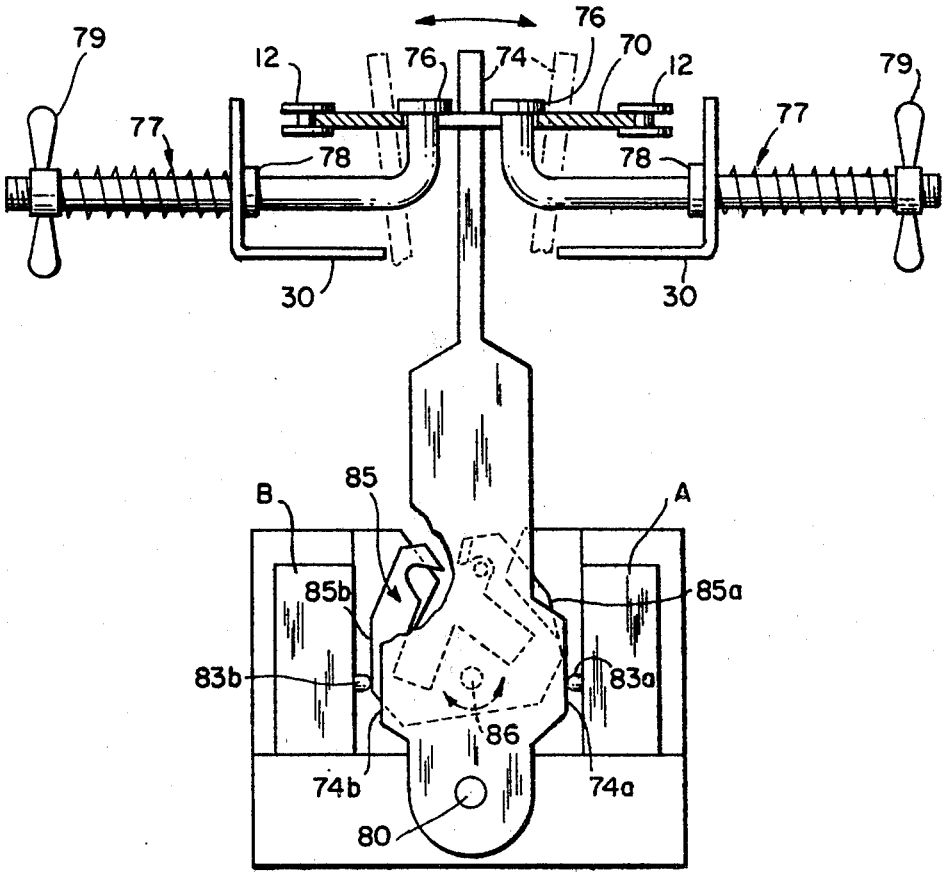
FIG. 9 is a view depicting the load lever pressure responsive means and cam actuator structure for operating the switch actuators of the motor.

As seen in FIGS. 2, 4 and 9, a pressure responsive means is provided in conjunction with a common switching means and is positioned between guide rails 30—30 near helical gear 22 for opening and closing door 10, and for starting and stopping the door when there is an obstruction in the path of the moving door. The aforesaid pressure responsive and common switching means includes a load responsive lever 70 which is pivotally connected to shaft 23 and is contoured such that its rear portion 71 is of a width sufficient to be enveloped by and in intimate contact with chain 12. The sides of the front portion 72 of load responsive lever 70 converge inwardly near its free end, the function of which shall be described in detail hereinafter. An opening 73 is located near the front end of load responsive lever 70 for receiving a limit switch lever 74. A pair of openings 75—75 are located near the rear portion of load responsive lever 70 for receiving respective end portions 76—76 of spring loaded adjusting members 77—77. The other end of each member 77 extends through opposing guide rails 30—30 and are in opposing axial relationship to each other. A stop 78 is provided on each member and located in contact with the inner surface of each guide rail 30, so that when a pressure adjustment on the load responsive lever 70 is desired, same can be obtained by the turning of wing nut 79 located on said other end member 77. It is now apparent that by turning either wing nut 79, load responsive lever 70 can be pivotally moved laterally so that limit switch lever 74 is centrally located within opening 73 when the door opener unit is in a normal at rest position.

As seen in FIG. 9, limit switch lever 74 extends downwardly and is pivotally mounted at 80 and is provided with protruding opposing contact surfaces 74*a* and 74*b* which are in contact with approximately one-half of the surface of respective actuators 83*a* and 83*b* of respective switches "A" and "B", said actuators being misaligned but in parallel relationship with each other. An actuating cam 85 is pivotally mounted at 86 and provided with contact surfaces 85*a* and 85*b* which are in contact with approximately the other half of respective actuators 83*a* and 83*b*. The operation of limit switch lever 74 and actuating cam 85, with only two switches, shall be described in detail hereinafter.

Figure 10:
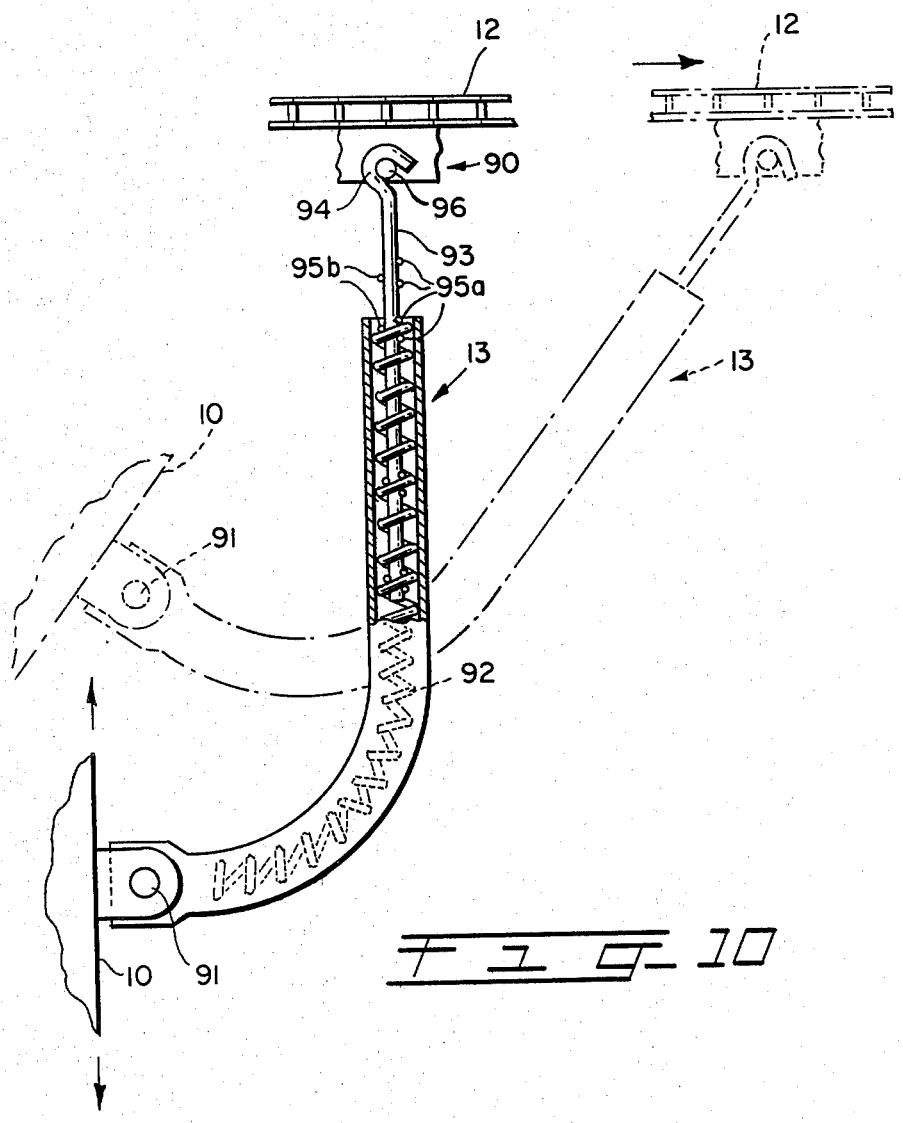
FIG. 10 is a cross-sectional view of the draw bar unit in its door opened and closed positions.
Figure 11:
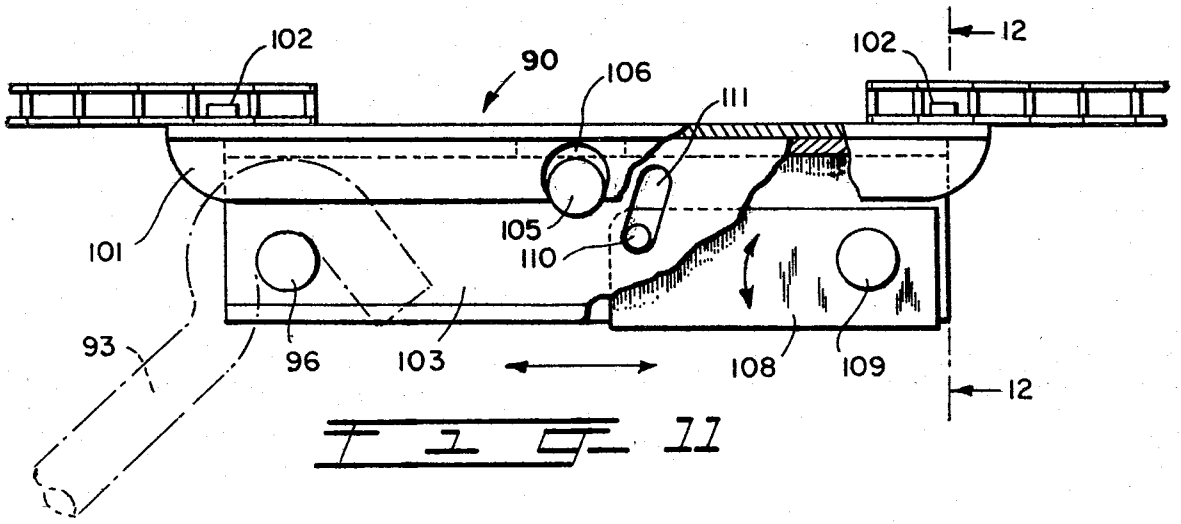
FIG. 11 is a side view, with a cut-away section, of the chain trolley.

As seen in FIGS. 1, 10 and 11, draw bar 13 interconnects a trolley, generally referred to at 90 and attached to chain 12, to door 10. Draw bar 13 is of tubular construction and arcuately shaped, one end of said bar being pivotally connected at 91 to door 10. A coiled spring 92 is inserted through the other end of the bar for approximately the full length thereof and compressed therein in the arcuate section. A pin 93 is provided with a hook 94 located at one end thereof, the pin shank being provided with a plurality of groups of projecting nibs located in predetermined positions thereon, each group consisting of a pair of nibs 95*a*—95*a* on one side of the shank and a single nib 95*b* located between said pair on the opposing side thereof. The free end of pin 93 is inserted through coiled spring 92 and rotated in such a manner that the spring coil is located between the nibs to securely hold the pin. After the pin is inserted the desired distance to provide the required tension and force for the door and trolley, hook 94 is connected to shaft 96 of trolley 90. From the foregoing, it can be seen that not only is the desired tension and force capable of being applied between the trolley and door, but that the compressed spring coil in the draw bar serves as a shock absorber when the door is moved to its full open and closed positions.

Figure 12:
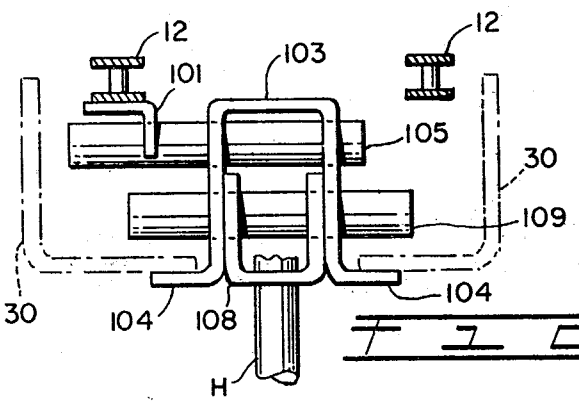
FIG. 12 is a view taken along the line 12—12 of FIG. 11.

As seen in FIGS. 11 and 12, trolley 90 includes a substantially right angularly shaped chain connector bracket 101 which is connected to chain 12 by any conventional fastening means 102. An inverted U-shaped carrier 103 is provided with right angular flanges 104—104 at its free end for riding beneath guide rails 30—30, said carrier having a pair of aligned openings in its upper central portion for receiving a pin 105 therethrough, said pin also extending through an arcuately shaped opening 106 in chain connector bracket 101.

A U-shaped release latch 108 is located within inverted U-shaped carrier 103 and is connected thereto by a pivotal pin 109, said release latch having a handle "H" extending therefrom for manual manipulation of the latch. An opening also is provided in release latch 108 for receiving a roll pin 110 which extends therethrough, said roll pin further extending through an angularly positioned elongated slot 111 in carrier 103. From the foregoing, it is now apparent that during a normal operation of the operator system, pin 105 is fully engaged in the arcuate opening 106 of carrier 103 so that the trolley is carried by the chain drive for opening and closing the door. In the event of a power failure, however, handle 110 is manually pushed upwardly whereupon the release latch is pivotally moved upwardly, causing roll pin 110 to move upwardly which, in turn, engages the top portion of elongated slot 111 to move pin 105 from carrier opening 106 so as to free the carrier 103 from the chain connecting member 101. As a result, the trolley is disengaged from the chain drive system and the door can be operated manually during a power failure of the operator system.

In now explaining the operation of the operator system, it shall be assumed that door 10 is fully closed and at rest. As such, as seen in FIG. 9, switches "A" and "B" are normally open by virtue of load responsive lever 74 being in a first position whereby its contacting surface 74*a* depresses contact actuator 83*a*, and actuating cam 85 being in a first position whereby its contacting surface 85*b* depresses actuator contact 83*b*.

Figure 13:
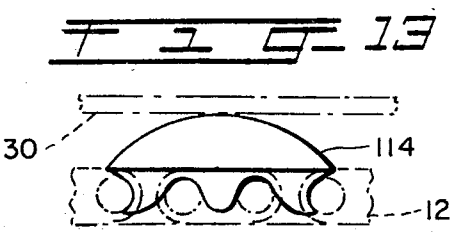
FIG. 13 is a detailed view of the drive cam for operating the load lever pressure responsive means.

Upon the actuation of a manually operated switch (not shown) or a remote control activator (not shown), a solenoid in the door opening circuit (not shown) is energized to move the actuating cam to its second position, whereupon its contacting surface 85*b* releases contact actuator 83*b* to close switch "B" and thereby permit current to energize motor 20. In its second position, cam actuator contacting surface 85*a* now moves into a depressing position on the other half of contact actuator 83*a* while limit lever contacting surface 74*a* still depresses the other half of contact actuator 83*a*. Upon energization of motor 20, gear 21 is driven to rotate helical gear 22 which, in turn, rotates sprocket 26 to drive chain 12. The trolley 90 pulls hook 93 and thereby causes draw bar 13 to pivot at 91 and lift the door overhead, as seen in FIG. 10, towards its open position. As the door nears its fully open position, a cam 115 (FIGS. 4 and 13) connected to chain 12 engages the inner lateral surface of rail 30 near the mid-portion of load responsive lever 70, causing a force to be applied against and pivotally move the free end of lever 74. In turn, as seen in FIG. 4, surface 73*a* of opening 73 engages and moves limit lever 74 to its second position whereupon its contacting surface 74*b* depresses its half of contact actuator 83*b* to open switch "B" to de-energize the motor and thereby stop the door movement in its fully open overhead position. As limit lever 74 moves to its second position, cam actuator 85 remains in its second position whereby its contacting surface 85*a* maintains contact actuator 83*a* depressed to keep its circuit open.

In order to close the door, a reverse motor circuit controlled by switch "A" is energized by activating the manual switch (not shown) or the remote control limit (not shown), whereupon the solenoid (not shown) causes the actuating cam to return to its first position, thereby permitting its contacting surface 85*a* to release contact actuator 83*a* and its contacting surface 85*b* to move into depressing engagement with its half area of contact actuator 83*b*, said contact actuator 83*b* still being depressed by limit lever contacting surface 74*b*. Consequently, the motor operates in a reverse direction, causing the chain drive and trolley to move in the opposite direction. The motor continues to operate as cam 115 moves along rail 30 and, as the cam begins to move away from rail 30, the tension applied against load responsive lever 70 is reduced, thereby causing limit lever contacting surface 74*b* to ride along switch contact actuator 83*b* until the cam is free of rail 30. At that time, contacting surface 74*b* is fully released from actuator 83*b* and returns to its first position. Upon release of actuator 83*b*, switch "B" opens to stop the motor, whereupon the door movement stops in its fully closed position.

In the event the door strikes any obstruction in its opening or closing path of travel, it is apparent that a tension or force is exerted upon the chain drive, thereby causing pressure responsive lever 70 to move and strike limit 74 to immediately disengage it from its actuator so as to open its motor circuit to stop the motor. Further, from the foregoing, it should be noted and be apparent that the movement of the door can also be stopped at any time by operating the manual control switch or remote control unit, which will immediately cause a return of the actuating cam to its position normally required to open the motor circuit.

I claim:

1. A door opener system, which includes, a pair of guide rails disposed in parallel relationship with each other, adjustable bracket means movable along the guide rails for mounting said guide rails to a structure, a compact unit having a motor with a driving gear extending therefrom, means for removably connecting the compact unit to the guide rails so that the driving gear meshes with the driven gear, a chain driven means unit cooperatively associated with the driven gear and operative in response to the operation of said driven gear, trolley means connected to the chain driven means for quick release from the chain driven means and manually operable in case of a power failure, a draw bar unit interconnecting the chain driven means unit to a door to be opened and closed, and electromechanical means connected to the system frame and cooperatively associated with the chain driven means unit for controlling the operation of the motor for starting and stopping the chain driven means unit, said electromechanical means including a pair of switches, each switch having a contact actuator therefor; a cam actuator operative in alternate first and second positions and having respective first and second actuator contacting surfaces, each actuator contacting surface movable into engagement with one-half of the surface area of its respective switch contact actuator; and, a load responsive lever operative in alternate first and second positions, and having first and second actuator contacting surfaces, each of the aforesaid actuator contacting surfaces movable into engagement with the other half of the surface area of its respective switch contact actuator.

2. In a door opener system having a pair of guide rails disposed in parallel relationship to each other, a compact motor unit removably connected to said guide rails and having a driving gear, a chain driven means including a driven gear, a draw bar unit interconnecting the chain driven means to a door to be opened and closed, and electromechanical means for opening, closing and otherwise moving said door, which comprises:

a load responsive lever cooperatively associated with the chain driven means, said load responsive lever having an opening therein, a pivotal limit lever switch connected to the system frame and responsive to pressure being applied to the chain driven means, said pivotal limit switch having a free end extending through said load responsive lever opening and a bottom portion having first and second actuating contacting surfaces, said limit lever switch movable between first and second positions, an actuating cam connected to the system frame and cooperatively associated with said pivotal limit lever, said actuating cam movable between alternating first and second positions and having first and second actuating contacting surfaces, and a pair of switches connected to the system frame and cooperatively associated with the pivotal limit lever switch and the actuating cam, each switch having a contact actuator whereupon one half of its surface area is engaged and depressed by the first actuating contact surfaces of the limit lever switch and cam actuator respectively in their respective first positions and the other half of its surface area is engaged and depressed by the second actuating contacting surfaces of the limit lever switch and cam actuator in their respective second positions.

3. In a door opener system, according to claim 2, wherein means are provided for activating the cam actuating surfaces between alternating first and second positions to start and stop the chain drive means to open and close the door.

4. In a door opener system, according to claim 3, wherein a cam is provided on the chain driven means, for engaging an inner guide rail surface to provide a force upon the chain which, in turn, causes the pivotal movement of the limit lever so that the load responsive lever opening surface engages the free end of the lever to thereby pivotally move same and cause its first actuating contacting surface to depress its respective contact switch actuator to open the motor circuit and stop the chain driven means.

5. In a door opener system, according to claim 4, wherein means are cooperatively associated with the load responsive lever for permitting a force to be applied against the chain driven means in response to the door striking an obstruction in its path of travel, thereby resulting in a movement of the free end of the load responsive lever to move its contact actuating surface in the desired position with the contact switch actuator to stop the motor.

6. In a door opener system, according to claim 1, wherein the first actuator contacting surface of the cam actuator engages one half the surface area of one switch contact actuator to open its motor circuit, and the first actuator contacting surface of the limit lever engages one half the surface area of the other switch to open its motor circuit, thereby resulting in the de-energization of each motor circuit to maintain the door in an at rest position.

7. In a door opener system, according to claim 6, wherein the contact switch actuators are misaligned but in parallel relationship with each other.

8. In a door opener system having a pair of guide rails disposed in parallel relationship to each other, a compact motor unit removably connected to said guide rails and having a driving gear, a chain drive means unit connected to the system frame and including a driven gear, electromechanical means for controlling the operation of the motor for starting and stopping the chain drive means, and a draw bar interconnecting the chain drive means unit to the door, which includes, an arcuately shaped tubular member for connection to the door, a coiled spring located within said tubular member, one section of the spring being compressed near one end of the tubular member to serve as a shock absorber for the door, and a pin having one end for insertion into the coiled spring whereby its shank is adjustably connected to the other section of the spring located near the other end of the tubular member, said pin having means located at its other end thereof for connection to the chain drive means.

9. In a door opener system, according to claim 8, wherein said shank of the pin is provided with a plurality of groups of projecting nibs thereon for receiving the coiled spring so as to hold same in its desired position to provide the desired tension between the door and drive chain means.

10. In a door opener system, according to claim 9, wherein each group of projecting nibs includes a pair of nibs located on one side of the shank and a nib located on the other side of the shank, said latter nib being located in alignment with substantially that area disposed between said pair of nibs.

11. In a door opener system, according to claim 10, wherein means are provided for pivotally connecting said end of the tubular member to the door.

12. In a door opener system, according to claim 11, wherein the means located at the other end of the pin is in the shape of a hook for connection to the chain drive means.

* * * * *